United States Patent [19]

Oberweiler et al.

[11] Patent Number: 4,907,740

[45] Date of Patent: Mar. 13, 1990

[54] DEVICE FOR ATTACHING A RAIL TO A BEARING ELEMENT

[75] Inventors: Günter Oberweiler, Munich; Johann W. Spies, Ingolstadt; Udo Wirthwein, Creglingen; Friedhelm Weber, Neuenrade, all of Fed. Rep. of Germany

[73] Assignee: Vossloh-Werke GmbH, Fed. Rep. of Germany

[21] Appl. No.: 209,133

[22] Filed: Jun. 20, 1988

[30] Foreign Application Priority Data

Jun. 19, 1987 [DE] Fed. Rep. of Germany ..... 3720381

[51] Int. Cl.[4] ..... E01B 9/38; F01B 9/68

[52] U.S. Cl. ..... 238/238; 238/351

[58] Field of Search ..... 238/283, 382, 351

[56] References Cited

U.S. PATENT DOCUMENTS

| | | | |
|---|---|---|---|
| 3,206,123 | 9/1965 | Baker | 238/351 |
| 3,519,205 | 7/1970 | Monclin et al. | 238/351 |
| 3,831,842 | 8/1974 | Tamura | 238/283 X |
| 4,150,791 | 4/1979 | Reynolds et al. | 238/283 X |
| 4,179,067 | 12/1979 | Baier | 238/283 X |
| 4,632,307 | 12/1986 | Weber | 238/351 X |

FOREIGN PATENT DOCUMENTS

| | | |
|---|---|---|
| 1261151 | 1/1968 | Fed. Rep. of Germany . |
| 1257817 | 2/1968 | Fed. Rep. of Germany . |
| 759146 | 1/1934 | France . |
| 7310907 | 10/1973 | France . |
| 8009195 | 10/1981 | France . |
| 373041 | 5/1932 | United Kingdom . |

*Primary Examiner*—Andres Kashnikow
*Assistant Examiner*—Matthew C. Graham
*Attorney, Agent, or Firm*—Sughrue, Mion, Zinn, Macpeak & Seas

[57] ABSTRACT

A device for attaching a rail to a bearing element (tie) (3) and comprising an elastic intermediate plate (34) and on top of this a rigid pressure distribution plate (35) which is arranged between the base (2) of the rail (1) and the tie (3); guide plates (10, 11) are attached to the tie (3) to provide lateral guidance of the base of the rail (2) and clamps (38) act on the base of the rail (2) and clamp the rail (1) to the tie (3). The elastic intermediate plate (34) projecting on both sides beneath the base (2) of the rail (1) extends on each side into a recess (16, 17) formed by the guide plate (10, 11). As a result, the elastic intermediate plate (34) can provide adequate resistance to the horizontal forces so that tilting of the rail is prevented. At the same time, the major forces of the clamps (38) are transmitted via the guide plates (10, 11) directly to the tie (3) so that non-uniform compression of the elastic intermediate plate (34) cannot occur during assembly and thus rail cant errors are avoided.

12 Claims, 2 Drawing Sheets

DEVICE FOR ATTACHING A RAIL TO A BEARING ELEMENT

SUMMARY OF THE INVENTION

The invention relates to a device for attaching railroad rails to a rigid trackway made up of bearing elements (ties), i.e. it is a device for attaching rails in a non-ballasted railroad track system.

Railroad superstructures mounted on rigid trackways are becoming more and more important as axle loads and maximum speeds are on the increase. It is important in the case of railroad track systems mounted on rigid trackways that the necessary degree of track flexing be achieved by placing intermediate plates or intermediate layers of elastic material between the ties and the rails. Various proposals have been made in this regard and some of them have already been implemented, at least for experimental purposes.

One example of this type of rail attachment system which has already been put into practice comprises a steel bearing plate, which is very broad in relation to the rail axis, and to it the rail is attached by means of two clamps acting on the base of the rail, and these clamps are secured by hook bolts with nuts. The bearing plate itself is held in place, together with and on top of the elastic intermediate plate in a correspondingly wide V-shaped depression in the concrete tie, by means of angled guide plates arranged on both sides; each of these guide plates possesses at the end facing away from the rail a sloping surface which is in contact with the corresponding sloping surface in the tie.

The angled guide plate and the bearing plate are each secured by one elastic clamp which acts on the one hand on the bearing plate and on the other pushes down the angled guide plate. The respective clamps of the angled guide plates are pretensioned by a bolt in such a way that the force resulting from the horizontal force transmitted under operating Conditions from the rail to the the bearing plate and from there to the angled guide plate, as well as the force resulting from the bolt tightening force, is directed via the sloping surfaces of the angled guide plate and tie towards the interior of the tie. The rail attachment described above is known under the designation Ioarv 180 (TM), while the angled guide plates which are used are the subject of German Pat. No. 1 257 817. The clamps used are essentially W-shaped. The basic configuration of these clamps is the subject of German Pat. No. 1 261 151.

Because of the system design, the known track attachments exhibit three degrees of tolerance; namely, the contact surfaces between the tie and the angled guide plate on the one hand and between the angled guide plate and the ribbed plate on the other hand, as well as the clamp attachment between rail and ribbed plate. As a result, the possibility exists that the necessary exactness of the positioning of the rail may be impaired. Furthermore, it was discovered that the necessary bedding resistance required for the audio frequency signalling circuit is very difficult to achieve. Finally, because this rail attachment method requires the use of four clamps per attachment point, it is relatively costly.

In another rail attachment device for a rigid trackway, which has also been tried out in tests, a ribbed plate is situated in a V-shaped depression in the tie; this ribbed plate is held on both sides by ribbed wedges each having a sloping surface which is in contact with a corresponding sloping surface in the tie. The rail together with the ribbed plate and the ribbed wedges are held down by two clamps arranged on both sides of the rails; these clamps are secured between the ribbed plate and the ribbed wedge by means of associated bolts. This type of rail attachment is designated Ioarv 207 (TM). The clamps correspond essentially to those which are used in the rail attachment system Ioarv 180 (TM).

This rail attachment system also possesses three degrees of tolerance; namely, the contact surfaces between the ribbed wedge and tie on the one hand, and between the ribbed wedge and the ribbed plate on the other, as well as between the rail and the ribbed plate. Since the ribbed wedges are merely held down on the tie, but are not locked in position, it is not impossible that when tightening the bolts the ribbed wedges can be twisted about the horizontal axis with the result that as the ribbed plate is displaced the inaccuracies can add up on one side of the rail. In addition, since the tightening force of the clamp bolts acts on the elastic intermediate layer via the ribbed plate, it can happen that if the clamp bolts are differently tightened the deflection of the elastic intermediate layer transverse to the longitudinal axis of the rail may be different, with the result that the cant of the two rails will differ. Finally, when the clamp bolts are tightened, the shape of the central loops of the clamps used is such that it is possible for relative movement to occur between the head of the bolt and the clamp in the direction of the rail, and consequently the bolt shafts may be bent.

The literature (German Pat. No. 1 261 151, FIG. 7) makes reference to a rail attachment, which is also intended for a rigid trackway. It comprises a bearing plate positioned on a concrete tie, and on this plate sits a rail with an elastic intermediate layer interposed between itself and the plate. A guide plate is located on either side of the rail and a projection on this plate engages positively in a horizontal direction in a corresponding recess in the bearing plate. The base of the rail and the guide plates are in each case forced onto the bearing plate by a clamp which is pretensioned by means of a bolt. In this rail attachment system, too, there is a risk that the rail will tilt under horizontal loading due to the lack of any resistance from the elastic intermediate layer which is approximately as wide as the base of the rail. In addition, here again the possibility cannot be excluded that if the clamp bolts are differently tightened the elastic intermediate layer will be unevenly compressed so that rail cant errors may be created.

The angled guide plates according to German Pat. No. 1 257 817, to which reference has already made, have proved their worth in long-term service in ballasted railroad tracks using concrete ties. The advantage of this type of rail attachment is that between the concrete tie and the rail only one component per side is provided to transmit the horizontal forces; that component is the angled guide plate by means of which the said horizontal forces can be reliably conducted into the concrete of the tie.

It is an object of the present invention to make use of the well-tried and proven concept of guide plates, as used in ballasted railroad tracks, and to design them in such a way for attaching rails to a rigid trackway that even in the case of heavy axle loads and high travel speeds, exact positioning of the rails is achieved.

In general terms, the invention makes use of an elastic intermediate plate which is arranged perpendicular to the rail axis, which is wider than the base of the rail, and which protects an appropriate amount on both sides of the rail; for this purpose, the guide plates each possess a recess open towards the base of the rail and into which the elastic intermediate plate projects. The rail attachment method according to the invention permits the elastic intermediate plate to be dimensioned large enough that a high degree of resistance to horizontal forces can be achieved. The sufficiently large dimensioning of the elastic intermediate plate is made possible in the manner according to the invention by the fact that suitably modified guide plates are used which possess an open recess into which the elastic intermediate plate can project.

At the same time this configuration of the guide plates ensures that to a large extent the forces exerted by the clamp on the guide plate are transmitted by this plate directly to the tie so that the elastic intermediate plate is not subjected to any non-uniform pretensioning by these forces, which in the known attachment systems has resulted in differential compression of the elastic intermediate plate and thus given rise to rail cant errors. In contrast, in the concept according to the invention precise canting of the rail is guaranteed.

The necessary exact fixing of the rail between the guide plates is guaranteed by the fact that the latter fit positively into the tie in relation to the horizontal forces, so that by tightening the clamp bolts the guide plates are clearly fixed in position.

The rail attachment method according to the invention is cheap to manufacture because it consists of just a few components, especially in comparison to rail attachment system Ioarv 180 (TM).

In addition, the device according to the invention permits simple regulation of the rail in height and direction. Lateral adjustment of the rails is made possible by using appropriately wide guide plates, while the height regulation is achieved by interposing appropriately thick intermediate layers between the rail and the tie.

When using the rail attachment according to the invention the absorption of the horizontal forces and simultaneous avoidance of rail cant errors are both further optimized by the fact that a rigid pressure distribution plate is arranged between the foot of the rail and the elastic intermediate plate. As a result, the resistance to the horizontal forces is still further increased and the forces are very uniformly transmitted to the elastic intermediate plate with the result that the latter is compressed uniformly over its entire main surface. The pressure distribution plate is flat and therefore simple in design and it can be cheaply made from rolled steel, while in the known rail attachments relatively expensive ribbed plates are used which are preferentially manufactured by forging.

According to another embodiment of the invention, the length and/or the width of the pressure distribution plate is greater than the corresponding dimensions of the elastic intermediate plate. This means that in the event of the elastic intermediate plate undergoing deformation, it cannot project beyond the pressure distribution plate and is thus not exposed to a high degree of wear.

It is additionally recommended that a further intermediate layer be interposed between the base of the rail and the pressure distribution plate, and that the width of this intermediate layer should be essentially as wide as the base of the rail. This intermediate layer may, for example, be electrically insulating.

In another advantageous configuration of the rail attachment according to the invention the guide plate comprises, in the area of the opening of the recess at the base of the rail, a support element which is in contact with the tie and via which the force of the clamp is at least substantially transmitted from the guide plate to the tie. By means of this design very high forces can be transmitted from the clamp via the guide plate to the tie without any risk of the guide plate becoming overloaded. This configuration permits the guide plates to be manufactured from a suitable plastic so that a further reduction in the cost of the rail attachment according to the invention is achieved.

In a further proposed embodiment of the guide plates as used according to the invention, these latter possess at least on the rail side a contact surface for the shaft of the bolt. This effectively counteracts any bending of the shaft of the clamp bolts. This contact surface can be produced from plastic without increasing the costs of the guide plates, by appropriately designing the die-casting tool used for producing the guide plates. This is achieved in a particularly simple manner when the contact surface for the bolt shaft is formed on the support element.

In a further advantageous embodiment of the rail attachment device according to the invention, the recess provided in the guide plate is formed by a U-profile open towards the tie, and the clearance height of this recess is greater than the combined thickness of the elastic intermediate plate and the rigid pressure distribution plate. In this way the elastic intermediate plate has a sufficient amount of play in the vertical direction in regard to the guide plates.

It is furthermore advantageous if the pressure distribution plate or the intermediate plate possesses a longitudinal hole running perpendicular to the axis of the rail to permit the bolt to pass through. By this means it is a simple matter to maintain the corresponding dimensions and it also permits unproblematical assembly of the rail attachment.

It is still further advantageous if the guide plate possesses a sloping surface at the end facing away from the rail, and that this sloping surface comes into contact with a corresponding sloping surface in the tie. In this way, the tried and proven concept according to German Pat. No. 1 257 817 for attaching the superstructure to a rigid trackway is applied also in the case of a non-ballasted rail attachment system.

Very precise fixing of the guide plates in regard to the tie and thus precise maintenance of the track gauge, is achieved if the guide plate possesses a protection extending parallel to the rail axis and engaging in a corresponding recess in the tie.

Finally, it is recommended to use basically known clamps; these clamps are essentially W-shaped and their middle loop partially engages around the shaft of the bolt and rests on the guide plate in the area of its support element. It its basic concept this clamp is the subject of German Pat. No. 1 261 151.

One embodiment of the invention will now be described in detail with reference to the accompanying drawings, wherein.

Figure 1:
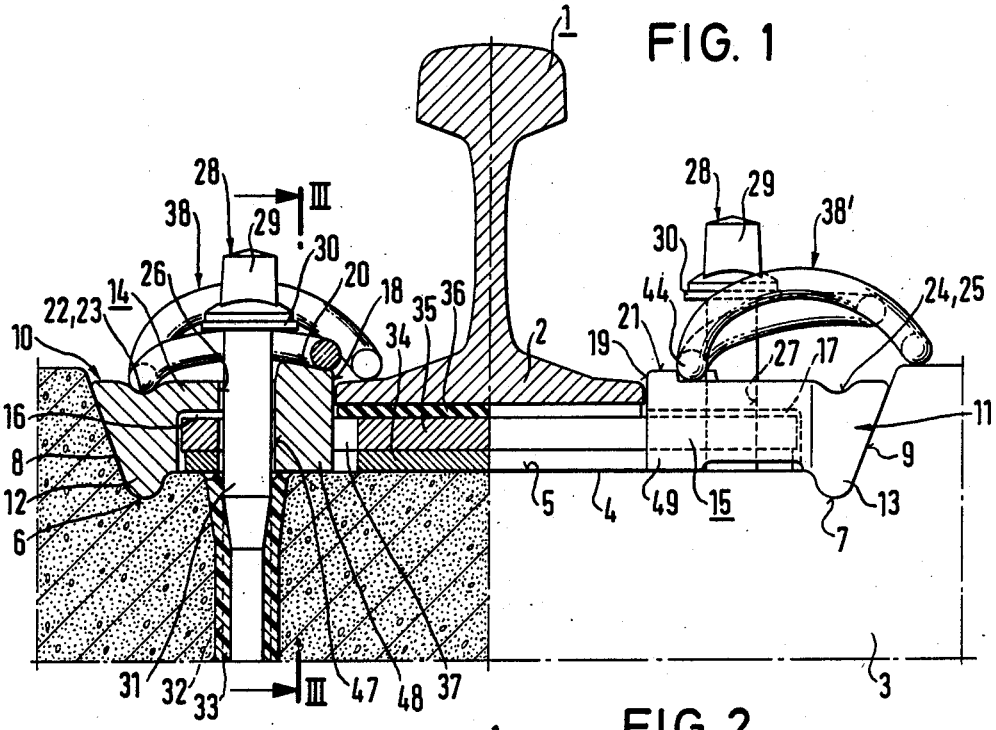
FIG. 1 is a vertical section through a rail attachment device according to the invention, showing the left-hand side of the rail attachment in the final-assembled state and the right-hand side of the rail attachment in the pre-assembly state.
Figure 2:
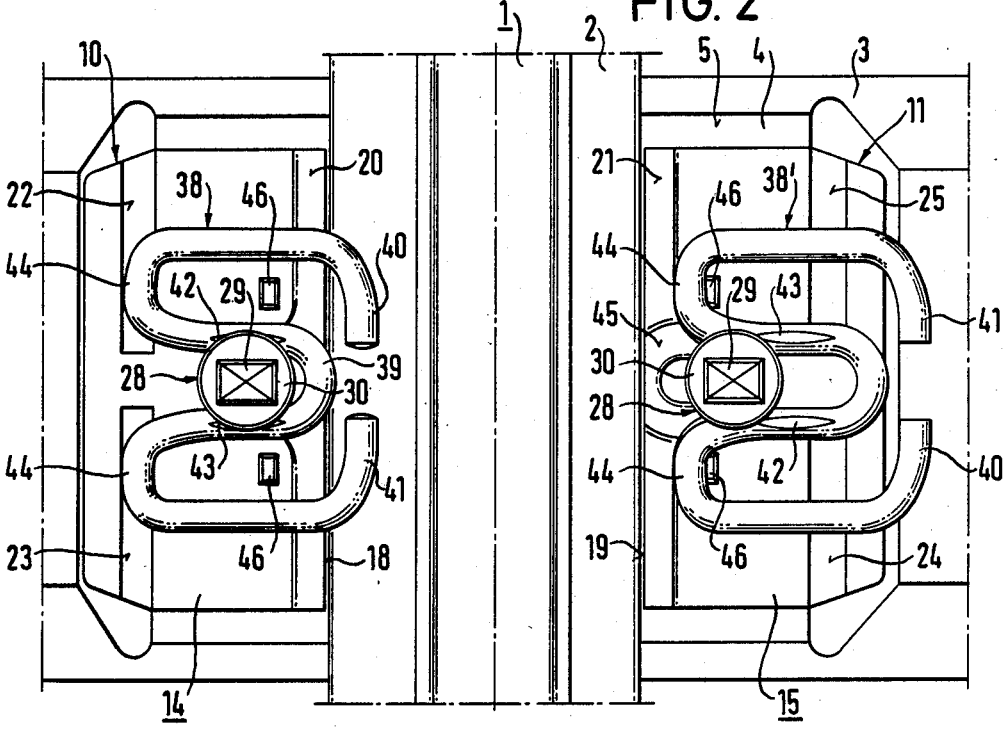
FIG. 2 shows a top view of the same arrangement as seen in FIG. 1.
Figure 3:
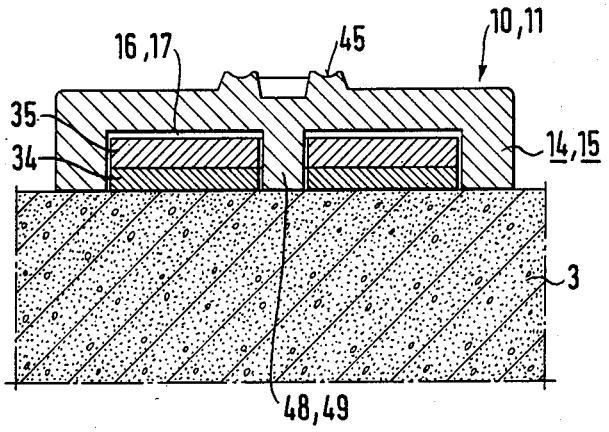
FIG. 3 shows a section along the line III—III through the arrangement seen in FIG. 1.
Figure 4:
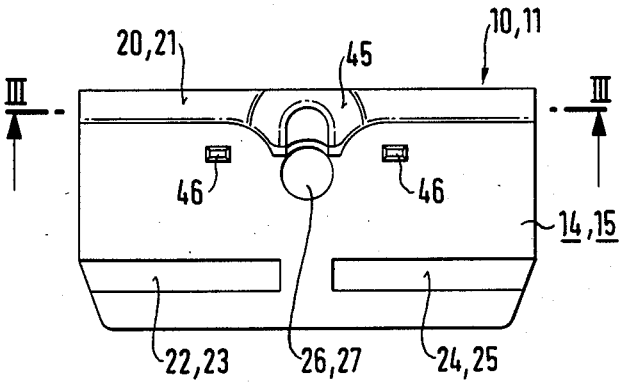
FIG. 4 shows a top view of an angled guide plate used in the rail attachment device according to the invention.

FIGS. 1 and 2 depict a symmetrically formed device for attaching a rail 1 of a pair of rails making up a railway track. This attachment device holds the rail 1 on both sides of its base or foot 2 and secures it in place on a tie 3, the tie being an embodiment of what is generally referred to as a "bearing element". The left half of FIG. 1 shows the rail attachment in the final-assembled, i.e. tightened, state in a vertical section perpendicular to the longitudinal axis of the rail, while the right half of the FIGURE shows the device in the pre-assembly, i.e. not yet tightened, state.

The tie 3, which is preferably made of concrete, possesses a longitudinal depression 4 running perpendicular to the longitudinal axis of the tie in the area in which a rail 1 is fitted to the tie. This depression comprises a flat seating surface 5 and at its ends two groove-shaped recesses 6, 7, which merge into sloping surfaces 8, 9.

In the end zones of the depression 4 running perpendicular to rail 1 in tie 3 there is fitted in each case a so-called "angled guide plate" 10, 11, which exhibits a cross sectional profile 12, 13 at the ends facing away from the rail 1, and this profile is matched to the groove-shaped recesses 6, 7 as well as to the sloping surfaces 8, 9 in the tie 3. These ends of the plates are therefore in full contact with the surfaces of the recesses 6, 7 and partly also with the sloping surfaces 8, 9 and thus engage in the tie 3.

Viewed in vertical cross section parallel to the longitudinal axis of the rail, the angled guide plates 10, 11 possess a U-shaped profile 14, 15 on the side facing towards the rail; this U-profile is open towards the tie 3, and the side legs of the profile rest on the seating surface 5 within the depression 4 in tie 3. As a result, pocket-like recesses 16 and 17 are formed between the inner surface of the U-profiles 14 and 15 and the seating surface 5 in tie 3.

Towards the rail 1 the angled guide plates 10 and 11 possess end surfaces 18 and 19 which are oriented parallel to the longitudinal axis of the rail and which form guides for the base of the rail 2 in relation to the horizontal forces.

In addition, on their upper surface, the angled guide plates 10, 11 each possess a rib 20 or 21 as well as in each case two appropriately oriented grooves 22, 23 or 24, 25 running parallel to the longitudinal axis of the rail.

In the area of the recesses 16, 17 the angled guide plates 10, 11 are provided with boreholes 26, 27 through which the tie bolts 28 pass. These latter bolts are fitted with a square head 29, a washer plate 30, a shaft 31 and a threaded section 32, which is screwed into a dowel 33 arranged in the tie 3 beneath each respective angled guide plate.

Furthermore,the angled guide plates 10, 11 each possess a support element 48, 49, which is in each case arranged in the area of the opening of recess 16, 17 at the base of the rail, and via this element 48, 49 the guide plate 10, 11 is additionally supported on the seating surface 5 in tie 3.

As already mentioned, the rail 1 with its base 2 is inserted between the end surfaces 18, 19 of the angled guide plates 10, 11. The base of the rail 2 rests on a combination of plates and an intermediate layer, i.e. this combination consists of an elastic intermediate plate 34 in contact with the concrete seating surface 5 in the tie, a rigid pressure distribution plate 35 and a non-elastic but electrically insulating plastic intermediate layer 36. The intermediate plate 34 and the pressure distribution plate 35 extend on both sides beyond the width of the base of the rail 2 in the direction of the longitudinal axis of the tie and engage with their end sections in the recesses 16, 17 of the angled guide plates 10, 11, making contact with the longitudinal walls of these guide plates to form an interlocking positive fit. The clearance height of the recesses 16, 17 is larger than the total thickness of the intermediate plate 34 and the pressure distribution plate 35. In order to permit the tie bolts 28 to pass through, the intermediate plate 34 and the pressure distribution plate 35 each possess a longitudinal hole 37 oriented along the axis of the tie.

The angled guide plates 10, 11 each possess a clamp 38. This is made of round cross section bar steel and is W-shaped in configuration; it comprises a central loop 39 which engages around the shaft 31 of the tie bolt 28 and two discontinuous side pieces 40, 41, which are convexly curved upwards and whose ends are bent inwards to face each other on a common axis. Flattened areas 42, 43 are provided on the central loop 39, and in the tightened state these areas engage with the underside of the plate washer 30 of the tie bolts 28.

In the left half of FIGS. 1 and 2, the clamp 38 is shown in the position it would occupy when the rail 1 is in its final assembled position on tie 3. In this position, the clamp presses down with its legs 40, 41 on the base 2 of the rail 1, while with its curved sections 44, located between the two legs 40, 41 and the central loop 39, it presses down on the angled guide plate 10, 11. In order to prevent the clamp 38 from rotating out of position, its curved sections 44 engage in grooves 23, 24 in the angled guide plate 10. For the same purpose, and in order to increase the contact surface of the central loop 39 of the clamp 38, the angled guide plate 10, 11 possesses in the area of this central loop 39 a congruent groove 45 in the area of the rib 20, 21. The support element 48, 49, which has been mentioned further above, is arranged beneath the area in which the central loop 39 of the clamp 38 presses down on the angled guide plate 10 or 11. In this way, the force exerted by the clamp 38 on the angled guide plate 10, 11 is essentially transmitted to the tie without the elastic intermediate plate 34 undergoing an non-uniform compression which may cause the rail cant error to which reference has already been made.

The right-hand side of FIGS. 1 and 2 show the clamp in position 38', i.e. just prior to final assembly. Here the clamp is rotated by 180° in relation to the final-assembled position so that it is in contact on the one hand with the angled guide plate 10, 11 and on the other hand with an area of the tie 3 which is facing away from the rail. In order to prevent the clamp 38' from rotating out of position even in the pre-assembly state, its curved sections 44 are held between the rib 21 and the oppositely arranged lugs 46.

For the purpose of laying a pair of rails, the ties manufactured by the tie-producing plant according to the pattern of tie 3, as shown in the illustrations, are supplied in such a manner that all the clamps 38 on the right hand side assume the position 38' as shown in the right half of FIG. 1 and 2, while on the left hand side they assume the laterally reversed position. At this stage the tie bolts 28 are tightened only enough to bring their plate washers 30 into gentle contact with the central loop 39 of the clamps 38, thereby ensuring that the angled guide plates 10, 11 as well as the intermediate plates 34 and the pressure distribution plates 35 and the clamps 38 on the respective tie 3 cannot be lost during transportation to the site or while they are being laid out on the base of the trackway.

When the ties 3 are laid out on the base of the trackway, the rails 1 of the pair of rails that make up the track are placed between the end surfaces 18, 19 of the angled guide plates 10, and 11, and at this time the plastic intermediate layers 36 are also inserted.

In order to clamp the base of the rail 2 onto the package of plates 34, 35, 36, and simultaneously also to finally clamp the angled guide plates 10, 11 in position on the tie 3, the tie bolts 2B are first slightly loosened; then, the clamps 38 are rotated by 180° about the shaft 31 of the respective tie bolt 28 until, for example, the clamp 38 shown in the pre-assembly position in the right half of FIGS. 1 and 2 is moved from its position 38' into a position which is laterally reversed from the position of the clamp 38 shown in the final-assembled position in the left half of FIGS. 1 and 2. Next, the tie bolts 28 are tightened to such an extent that, due to the contact of the plate washer 30 with the flattened surfaces 42, 43 of the central loop 39 of the clamp 38, the apex of the central loop 39 of the clamp 38 is forced down against the ribs 20 or 21 of the angled guide plates 10 or 11. As a result, the angled guide plates 10, 11 are firmly held down in place on the tie and the base 2 of the rail 1 is firmly clamped via the package of plates 34, 35, 36 onto the tie 3.

The rail attachment device described here has a number of advantages which will be described in detail in the following.

Compression of the end sections of the elastic intermediate plate 34 when the angled guide plates 10, 11 are forced down onto the tie 3 is essentially avoided because these end pieces are located in the recesses 16, 17 of the angled guide plates 10, 11. Instead, the force applied by the clamp 38 is transmitted via the angled guide plate 10, 11 essentially directly to the tie 3. This guarantees that the rail cant angle is maintained with the required degree of exactness, even if the two clamps at a particular attachment point are perhaps unevenly tightened.

In addition, the elastic intermediate plate is extended along the axis of the tie far beyond the width of the base of the rail, as a result of which it can exert a large amount of resistance to the horizontal forces acting on the rail which would otherwise cause the rail to tilt to an impermissible extent. The pressure distribution plate 35 in particular contributes greatly to achieving this end. In contrast to the ribbed plates, this plate is of flat configuration and therefore it is simple to produce from rolled steel.

The horizontal forces acting on the rail 1, transverse to its longitudinal axis, are transmitted by the angled guide plates 10, 11 to the sloping surfaces 8, 9 of the tie 3 and into the concrete body of the tie. The engagement of the angled guide plates 10, 11 in the grooves 6, 7 of tie 3 simultaneously also ensures that the plates are prevented from twisting out of position when they are tightened onto the tie 3. Using the angled guide plate 10, 11 means that only one component is needed on each side of the track between the base 2 of the rail 1 and the sloping surfaces 8, 9 of the tie 3 which absorb the horizontal forces; this makes construction cheap and simple and also lowers the tolerances.

During the tightening of the tie bolts 28 their shafts 31 are precisely located by the boreholes 26 and 27 in the angled guide plates 10, 11 so that any bending of the tie bolts while the rail 1 is tightened onto tie 3 is prevented. This is achieved in particular by the fact that on the support element 48, 49, of the angled guide plate 10, 11, the surface facing away from the rail forms a contact surface 47 for the shaft 31 of the tie bolt 28.

Naturally, the described embodiment can be modified without abandoning the principle of the invention.

Thus, it is possible for the angled guide plates 10, 11, whose sloping surfaces 12, 13 rest against corresponding sloping surfaces 8, 9 in the tie, to be replaced by guide plates which are in some other way interlockingly fitted into the tie in relation to the horizontal forces.

Instead of the W-shaped clamps 38, it is possible to use other clamps.

In addition, the rail attachment device according to the invention need not be used only in conjunction ties, onto which it is mounted, but instead it can also be used in conjunction with other bearing elements such as with appropriately designed bearing plates.

The embodiments of the invention in which an exclusive property or privilege is claimed are defined as follows:

1. A device for attaching a railroad rail having a foot to a rigid trackway made up of bearing elements, wherein:

(a) two guide plates are provided on each bearing element and are arranged on opposite sides of the foot of the rail to provide lateral guidance of the rail;

(b) a clamp which is tightened by a bolt is provided for each guide plate; the clamp pressing, on the one hand, the guide plate, and on the other hand, the foot of the rail onto the bearing element;

(c) at least one elastic intermediate plate is arranged between the foot of the rail and the bearing element;

(d) the elastic intermediate plate is wider than the foot of the rail in the plane perpendicular to the longitudinal axis of the rail and projects accordingly on both sides of the foot;

(e) the guide plates each possess a recess which is open towards the foot of the rail and into which the elastic intermediate plate projects; and the guide plates includes a support element in the area of the opening of the recess at the foot of the rail; said support element is in contact with the bearing element, and the force exerted by the clamp is at least substantially transmitted via the support element from the guide plate to the bearing element.

2. A device according to claim 1, wherein a rigid pressure distribution plate is arranged between the foot of the rail and the elastic intermediate plate.

3. A device according to claim 2, wherein the length of the rigid pressure distribution plate is greater than the corresponding dimensions of the elastic intermediate plate.

4. A device according to claim 2, wherein a further intermediate layer is arranged between the foot of the rail and the rigid pressure distribution plate, and the width of said intermediate layer corresponds substantially to the width of the foot of the rail.

5. A device according to claim 2, wherein the width of the rigid distribution plate is greater than the corresponding dimension of the elastic intermediate plate.

6. A device according to claim 1, 2 or 3, wherein at least on the side facing the rail a contact surface for the shaft of the bolt is provided in the guide plate.

7. A device according to claim 1, 2 or 3, wherein at least on the side facing the rail a contact surface for the shaft of the bolt is provided in the guide plate, the contact surface for the shaft of the bolt being formed on the support element which is a part of said guide plate adjacent the foot of the rail.

8. A device according to claim 2 or 3, wherein the recess provided in the guide plate is formed by a U-profile which is open towards the bearing element, and the clearance height of said recess is greater than the overall thickness of the elastic intermediate plate and the rigid pressure distribution plate.

9. A device according to claim 1, 2 or 3, wherein the rigid pressure distribution plate and the elastic intermediate plate possess a longitudinal hole running perpendicular to the axis of the rail through which the bolt and the support element on the guide plate can pass.

10. A device according to claim 1, 2 or 3, wherein the guide plate possesses a sloping surface on the end facing away from the rail, and this sloping surface rests against a corresponding sloping surface in the bearing element.

11. A device according to claim 1, 2 or 3, wherein the guide plate possesses a projection running parallel to the axis of the rail and engaging in a recess in the bearing element.

12. A device according to claim 1, 2 or 3, wherein the clamp is essentially W-shaped and has a central loop which partially engages around the shaft of the bolt and rests on the guide plate.

* * * * *